US005911361A

United States Patent [19]

Suzuki et al.

[11] Patent Number: 5,911,361

[45] Date of Patent: Jun. 15, 1999

[54] VISCOUS HEATER

[75] Inventors: Shigeru Suzuki; Takashi Ban; Tatsuyuki Hoshino; Tatsuya Hirose, all of Kariya, Japan

[73] Assignee: Kabushiki Kaisha Toyoda Jidoshokki Seisakusho, Kariya, Japan

[21] Appl. No.: 08/859,056

[22] Filed: May 21, 1997

[30] Foreign Application Priority Data

Jun. 7, 1996 [JP] Japan ..... 8-145867

[51] Int. Cl.[6] ..... B60H 1/02

[52] U.S. Cl. ..... 237/12.3 R; 126/247

[58] Field of Search ..... 237/12.3 R, 12.3 B; 126/247; 122/26

[56] References Cited

U.S. PATENT DOCUMENTS 4,974,778 12/1990 Bertling ..... 237/12.3 B
5,573,184 11/1996 Martin ..... 237/12.3 R

OTHER PUBLICATIONS

English Language Abstract of JP 5–270 250, from Patent Abstracts of Japan, Jan. 21, 1994, vol. 18, No. 41.

*Primary Examiner*—Henry A. Bennett
*Assistant Examiner*—Derek S. Boles
*Attorney, Agent, or Firm*—Brooks Haidt Haffner & Delahunty

[57] ABSTRACT

A viscous heater includes a heat generating chamber 10 of a sealed structure. The viscous heater is further provided with a storage chamber SR, which is in communication with the heat generating chamber 10 at its central part, via a recovery hole 3*c*, a feed groove 3*f* and a feed hole 3*e* formed in a rear plate 3 and a rear housing 4. The storage chamber SR can store an amount of the viscous fluid, which exceeds the volume of a heat generating gap between an inner surface of the heat generating chamber and an outer surface of a rotor 16. The speed of degradation of the viscous fluid is slowed, while eliminating the necessity of a strict administration of a charged amount of the viscous fluid.

18 Claims, 6 Drawing Sheets

VISCOUS HEATER

BACKGROUND OF THE INVENTION

1. Field of the Invention

The present invention relates to a viscous heater for generating heat by a shearing a viscous fluid which is subjected to a heat exchange with a heating fluid as a heat source of a heating apparatus.

2. Background of the Invention

Japanese Unexamined Utility Model Publication No. 3-98107 discloses a viscous heater of a variable capacity, provided with front and rear housings facing and connected with each other so as to form a heat generating chamber, and a water jacket located around the heat generating chamber. The housing is formed with an inlet port for introducing the heating water (fluid) into the water jacket and an outlet port for taking out the heated water from the water jacket to an outside heating circuit. A driving shaft is rotatably supported by the front and rear housings via respective bearing units, while a rotor is connected to the shaft in such a manner that the rotor rotates in a heat emission chamber. The heat emission chamber and the rotor have faced inner and outer surfaces, on which surfaces labyrinth grooves, which are located adjacent with-each other, are formed, while a gap is formed between the confronting surfaces, so that a viscous fluid, such as a silicone oil, is filled in the gap.

The viscous heater is further provided with a diaphragm unit arranged at a location below the front and rear housings and has upper and lower covers and a diaphragm arranged between the upper and the lower covers, so that a control chamber is formed on one side of the diaphragm. The front and rear housings are, at their top parts, formed with vent holes which are in communication with an atmosphere, while the upper and lower covers are formed with communication pipes, which are in communication with the control chamber. An arrangement of the diaphragm is such that the inner volume of the control chamber is controlled in accordance with various factors, such as an intake vacuum and a spring force of a coil spring.

The viscous heater is incorporated into a heating device for a vehicle such that a rotating movement of a crankshaft of an internal combustion engine of the vehicle is transmitted to the driving shaft, which causes the rotor to be rotated in the heat emission chamber. As a result, shearing of the viscous fluid occurs in the gap between the confronting surfaces, resulting in the generation of heat, which is subjected to a heat exchange with the water recirculated to the water jacket, so that the recirculated water is heated and is used at the heating circuit for executing a heating operation.

In Japanese Unexamined Utility Model Publication No. 3-98107, in order to vary the capacity of the viscous heater, when the degree of the heating is too strong, the diaphragm is moved downwardly by the action of the manifold vacuum, which causes the volume of the control chamber to be increased. As a result, the viscous fluid in the heat generating chamber is recovered to the control chamber, so that the heat generating amount at the gap between the confronting surfaces of the heat generating chamber and the rotor is reduced, thereby weakening the heating. Contrary to this, when the degree of the heating is too weak, the diaphragm is moved upwardly by the action of the manifold vacuum and the force of the spring, which causes the volume of the control chamber to be decreased. As a result, the viscous fluid in the heat generating chamber is issued to the heat generating chamber, so that the heat generating amount at the gap between the confronting surfaces of the heat generating chamber and the rotor is increased, thereby strengthening the heating.

In the prior art structure of the viscous heater, recovery of the viscous fluid from the heat generating chamber to the control chamber causes air to be introduced into the heat generating chamber via the vent hole, thereby canceling an occurrence of a vacuum in the heat generating chamber. In other words, contact of the viscous fluid with the newly introduced air is occurs every time when a reduction of the heating capacity is occurs, thereby speeding-up degradation of the viscous fluid.

Furthermore, in the prior art structure, the volume of the control chamber, which is under an expanded condition, is equalized to the volume of the heat generating gap between the inner surface of the heat generating chamber and the outer surface of the rotor. Thus, a limited amount of the viscous fluid is merely moved between the control chamber and the heat generating chamber in accordance with the expansion or contraction of the control chamber. Thus, it is likely that a particular part of the viscous fluid is subjected to shearing at the heat generating gap. Thus, a quick degradation of the viscous fluid is likely to occur.

SUMMARY OF THE INVENTION

An object of the present invention is to provide a viscous heater capable of overcoming the above mentioned difficulty in the prior art.

Another object of the present invention is to provide a viscous heater capable of maintaining an advantage of delayed degradation by elimination of moisture, while eliminating the necessity of strict control of the amount of the viscous fluid.

Still another object of the present invention is to provide a viscous heater capable of maintaining an advantage of a delayed degradation by maintaining that only a specific portion of the viscous fluid is subjected to shearing.

According to the present invention, a viscous heater is provided, comprising:

a housing;

a heat generating chamber in the housing;

a heat emission chamber in the housing, the heat emission chamber being located adjacent to the heat generating chamber and being for receiving a liquid to be recirculated;

a drive shaft which is rotatably connected to the housing, and;

a rotor which is located in the heat generating chamber and is rotated by said drive shaft;

the rotor and the heat generating chamber having opposed surfaces between which a gap is created;

a viscous fluid located at the gap generates heat due to the shearing of the viscous fluid at the gap during the rotating movement of the rotor; and the heat generating chamber is outwardly sealed, while said housing has a storage chamber which is also outwardly sealed and is in communication with the heat generating chamber via a recovery passageway as well as a feed passageway in said housing, the storage chamber being capable of storing a volume of the viscous fluid which exceeds the volume of said gap.

In the present invention, the heat generating chamber as well as the storage chamber are under a sealed condition, so that the viscous fluid in the chambers is prevented from contacting newly introduced air, which can cause a-moisture therein to be captured. Thus, degradation of the viscous fluid is less likely.

Furthermore, in the viscous heater according to the present invention, it is possible that an amount of the viscous fluid larger than the volume of the gap is stored, which is advantageous in that a strict administration of the amount of the viscous fluid is unnecessary. Due to the communication of the storage chamber with the heat generating chamber, a Weissenberg effect together with movement of a gas allows, on one hand, the viscous fluid from the heat generating chamber to be recovered to the storage chamber and allows the viscous fluid to be fed to the heat generating chamber, on the other hand. As a result, an increased amount of generation of heat is obtained, while replacement of the viscous fluid always occurs between the heat generating chamber and the storage chamber while keeping a sufficient degree of the shaft seal performance.

In a viscous heater in accord with another aspect of the invention, said recovery passageway is in communication with the heat generating chamber at its central part and the recovery passageway and the feed passageway are always under an opened condition during the operation of the drive shaft.

In the structure of the viscous heater, during the rotating movement of the drive shaft, the Weissenberg effect together with the movement of the gas allows the viscous fluid to be always replaced between the heat generating chamber and the storage chamber.

In the structure of the viscous heater, said recovery passageway is, at its end open to the storage chamber, located at a position above the level of the liquid state viscous fluid in the storage chamber, and said feed passageway is, at its end open to the storage chamber, located at a position below the level of the liquid state viscous fluid in the storage chamber.

In this structure of the viscous heater, prior to the application of rotating movement to the drive shaft, the weight of the viscous fluid together with the movement of the air allows a level of the viscous fluid to be equalized between the heat generating chamber and the storage chamber. As a result, the an amount of the viscous fluid to be subjected to shearing by the rotor is small, which enables a small torque to be sufficient to make the device able. The setting of the effective areas of the recovery passageway and the feed passageway is such that, after starting up the operation, the amount of the recovered viscous fluid furnished to the storage chamber is larger than the amount of the viscous fluid supplied to the heat generating chamber, so that a sufficient amount of the viscous fluid is supplied to the heat generating chamber in order to generate an increased amount of heat at the gap between the confronting surfaces of the heat generating chamber and the rotor.

During the operation, the viscous fluid in the heat generating chamber, which is subjected to shearing, includes a gas in the form of bubbles. An end of the recovery passageway at the storage chamber located above the level of the viscous fluid therein allows, advantageously, the bubbles to be moved, in all probability, to the storage chamber. Furthermore, the weight of the viscous fluid allows the viscous fluid to be replaced between the heat generating chamber and the storage chamber. Furthermore, under the effect of the surface tension of the viscous fluid, the rotating rotor causes the viscous fluid in the storage chamber to be sucked into the heat generating chamber via the feed passageway.

When the rotating movement to the drive shaft ceases, the weight of the viscous fluid together with the movement of the air allows the fluid level to be equalized between the heat generating chamber and storage chamber. Furthermore, locating the end of the feed passageway below the liquid level of the viscous fluid in the storage chamber allows easy administration of the amount of the viscous fluid.

In the viscous heater in accordance with yet another aspect of the invention, said feed passageway has an effective flow area which is larger than that of the recovery passageway. The structure allows the viscous fluid to be quickly fed to the heat generating chamber. Thus, a quick increase in the heat generating amount at the gap between the confronting surfaces of the heat generating chamber and the rotor is obtained after the start up of the device.

In the viscous heater, a feeding means is arranged in the feed passageway for positive feeding of the viscous fluid in the storage chamber into the heat generating chamber. As a result of the positive feed of the viscous fluid from the storage chamber to the heat generating chamber, a quick increase in the heat generating amount is obtained at the gap between the inner surface of the heat generating chamber and the outer surface of the rotor.

In the viscous heater, said feeding means comprise a pump having a shaft which is concentric with respect to the drive shaft and a screw thread on the shaft. Thus, a very simplified and convenient structure of a screw pump is obtained.

In the viscous heater, said recovery passageway has an end opened to the heat generating chamber having an edge which has, at least at a forward portion in the direction of the rotating movement of the rotor, a formation which causes the gas to be easily sucked from the heat generating chamber to the storage chamber under the effect of the rotating movement of the rotor. By this structure, an easy movement of the bubbles to the storage chamber is obtained after the start-up, which allows the viscous fluid to be quickly supplied to the entire part of the heat generating chamber, thereby increasing the heat generating amount at the heat generation gap.

In the viscous heater, said formation is constructed by a beveling. Such a beveling on the edge of the end of the recovery passageway to the heat generating chamber allows the bubbles in the heat generating chamber to be effectively drawn by the recovery passageway toward the storage chamber.

In the viscous heater, said recovery passageway has an end opened to the heat generating chamber having an edge which has a front portion of an arc or straight shape in the direction of the rotating movement of the rotor, having a curvature, which is larger than that of a rear portion of the edge. Due to such a shape of the edge at the end of the recovery passageway opened to the heat generating chamber, the bubbles therein are prevented from being subjected to a large shrinking force, which allows the bubbles to be easily drawn by the recovery passageway and to be easily moved to the storage chamber.

In the viscous heater, said feed passageway is extended outwardly toward a peripheral portion of the rotor. In the structure of the viscous, heater the recovered viscous fluid in the storage chamber is fed to the outer peripheral area of the heat generating chamber via the feed passageway. The viscous fluid fed to the peripheral area is moved to the central area of the heat generating chamber under the Weissenberg effect, thereby quickly increasing the heat generating amount at the heat generating gap.

In the viscous heater, the arrangement of said feed passageway is such that the viscous fluid is easily drawn into the heat generating chamber from the storage chamber due to the rotating movement of the rotor. In this structure, an easy movement of the viscous fluid to the heat generating chamber after the start-up is obtained, which allows the viscous fluid to be quickly moved to the entire part of the heat generating chamber, thereby quickly increasing the heat generating amount at the heat generating gap.

In the invention, said feed passageway is a groove on the housing and is extending radially, which groove is inclined forwardly in the direction of the rotating movement of the rotor. This arrangement has an advantage in its simplicity of construction.

In the invention, said feed passageway is a groove on the housing and extending radially, which groove is curved forwardly in the direction of the rotating movement of the rotor. This arrangement also has an advantage in its simplicity of construction.

In the invention, said groove has an edge which is, at least at the forward portion in the direction of the rotating movement of the rotor, beveled. Due to the beveling, a smooth movement of the viscous fluid to the heat generating chamber is obtained.

In the viscous heater, said housing is further formed with a gas passageway which connects the heat generating chamber and the storage chamber with each other. In this structure, the supply of the viscous fluid into the heat generating chamber after the start up allows the gas to be pushed to the storage chamber via the gas passageway, thereby completely eliminating gas in the heat generating chamber, thereby making it easy to obtain a desired heat generating amount. Furthermore, the recovering of the viscous fluid to the storage chamber after the stoppage of the device allows the gas to be pushed by the flow of the viscous fluid so that the gas is easily moved from the storage chamber to the heat generating chamber via the gas passageway.

In the viscous heater, said gas passageway connects the upper part of the heat generating chamber and the upper part of the storage chamber with each other. By this structure, due to the weight of the viscous fluid, an easy movement of the gas is obtained via the gas passageway. In this construction, the gas passageway is advantageously located above the liquid level of the viscous fluid in the storage chamber.

In the viscous heater, said rotor is formed as a flat disk shape. Due to the employment of the disk shape of the rotor, the viscous fluid has an increased liquid area which is transverse to the shaft axis, thereby generating the Weissenberg effect in a positive manner.

In the viscous heater, said rotor has, at its central part, at least one hole extending axially therethrough. Due to this arrangement, the viscous fluid at a location between a front wall surface of the heat generating chamber and the front surface of the rotor is easily recovered to the storage chamber and the viscous fluid in the storage chamber is easily fed to the location between the front inner surface of the heat generating chamber and the front outer surface of the rotor.

BRIEF DESCRIPTION OF ATTACHED DRAWINGS

DESCRIPTION OF PREFERRED EMBODIMENTS

Now, embodiments of the present invention will be explained with reference to attached drawings.

First Embodiment

Figure 2:
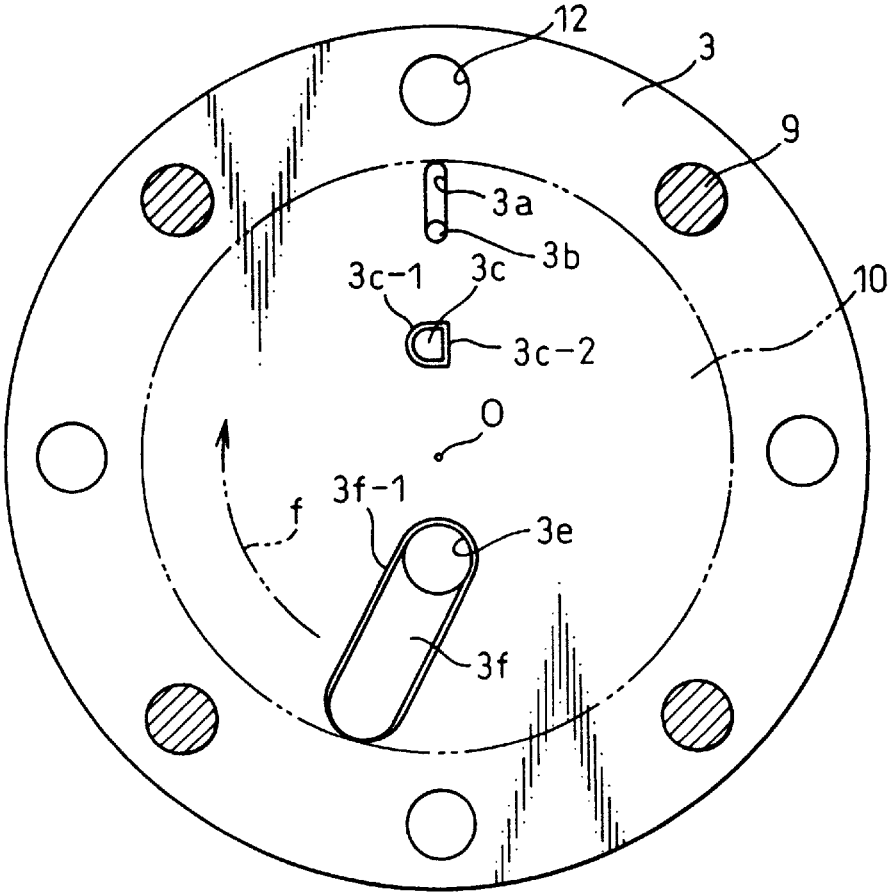
FIG. 2 is a transverse cross sectional view of the viscous heater taken along a line II—II in FIG. 1.

In the first embodiment of the viscous heater according to the present invention, reference numeral 1 is a front housing, 2 a front plate, 3 a rear plate, and 4 a rear housing. These parts 1, 2, 3 and 4 are, together with a gasket 5, O-rings 6*a* and 6*b* and a gasket 7, connected with each other by means of a plurality of circumferentially spaced bolts 9 as shown by FIG. 2.

The front plate 2 is, at its rear side, formed with a recess 2-1, which faces a generally flat front surface of the rear plate 3, so that a heat generating chamber 10 is formed between the front and rear plates 2 and 3. The front housing 1 has, at its rear side, a recess 1-1, which is faced with a front surface of the front plate 2, so that a front water jacket FW as a front heat emission chamber located adjacent the front part of the heat generating chamber 10 is formed between the front housing 1 and the front plate 2. The rear housing 4 is, at its front side, formed with an annular rib 4*a* extending axially, so that the annular rib 4*a* abuts at its front end surface the gasket 7. As a result, an annular rear water jacket RW as a heat emission chamber located adjacent the rear part of the heat generating chamber 10 is formed between the rear plate 3 and the rear housing 4 at a location radially outwardly from an outer peripheral surface of the annular rib 4*a*. Furthermore, a storage chamber SR is formed between the rear plate 3 and the rear housing 4 at a location radially inwardly from the inner peripheral surface of the annular rib 4*a*.

The rear housing 4 is, at its rear side, formed with an inlet port 11 and an outlet port (not shown), which are opened to the rear water jacket RW. The front and rear plates are formed with a plurality of circumferentially spaced pairs of axially aligned holes providing water passageways 12 for obtaining communication between the front water jacket FW and the rear water jacket RW.

The front plate 2 is, at its front side, formed with a boss portion 2*a*, which extends axially toward the front housing 1. Inside the boss portion, a shaft seal unit 13 is arranged. The front housing 1 is, at its front side, formed with a boss portion l*c*, inside of which a bearing unit 14 is arranged. The boss portion 2*a* of the front plate 2 is fitted to an opening in the boss portion 1*c* of the front housing 1, while the boss portion 2*a* abuts the shaft bearing unit 14.

A drive shaft 15 is inserted through the boss portion 1*c* of the front housing 1 and the boss portion 2*a* of the front housing 1 via the bearing unit 14 and the shaft seal unit 13, respectively, so that the drive shaft 15 is rotatably supported by the housing 1.

A rotor 16 of a flattened disk shape is arranged in the heat generating chamber 10 and is press fitted to a rear end of the drive shaft 15, so that the rotor 16 rotates integrally with the rotating movement of the drive shaft 15. The rotor 16 is, at its central part, formed with openings 16*a* extending axially therethrough.

The rear plate 3 is, at its front side opened to the heat generating chamber 10, formed with a gas passageway constructed by a gas groove 3*a* extending inwardly from the top end of the heat generating chamber 10 and a hole 3*b* which is, on one hand, in communication with the inner end of the groove 3*a* and is in communication with the gas storing chamber SR on the other hand. It should be noted that the groove 3*a* for the gas is, at its end opened to the heat generating chamber 10, beveled. Furthermore, at a location slightly above the central part of the plate 3, the rear plate 3 is formed with an opening 3*c*, as a recovery hole, extending axially between the heat generating chamber 10 and the storage chamber SR.

Figure 3:
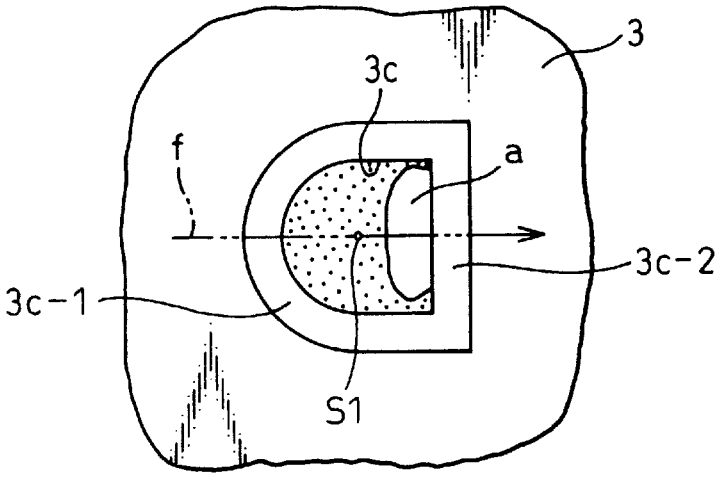
FIG. 3 is an enlarged front elevational view of a first recovery hole at its end to the heat generating chamber.
Figure 4:
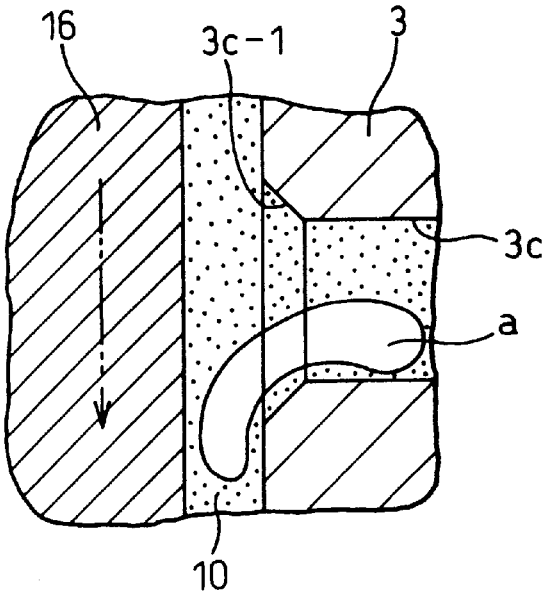
FIG. 4 is an enlarged cross sectional view of the first recovery hole.

As shown in FIGS. 2, 3 and 4, the recovery hole 3*c* is, at the end adjacent the heat generating chamber 10, formed with an edge, which is, in the direction of a rotating movement of the rotor 16 as shown by an arrow f in FIG. 2, formed by an arc shaped rear portion 3*c*-1 which is recessed opposite to the rotating direction and which is located on a circle about a center S1 as shown in FIG. 3 and a straight front portion 3*c*-2, which extends transversely with respect to the rotating direction f of the rotor 16. As shown in FIG. 4, the edge is beveled.

Figure 1:
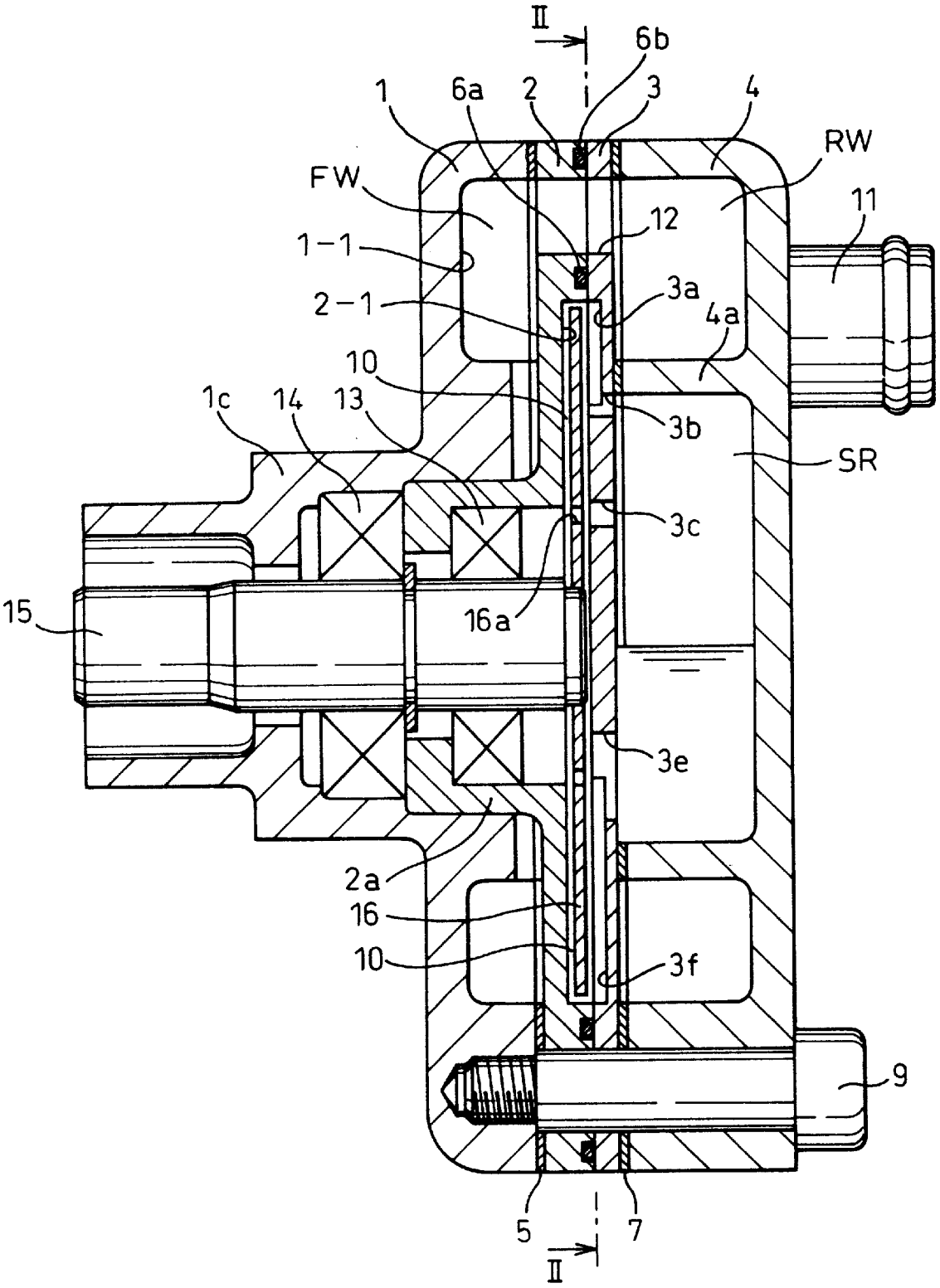
FIG. 1 is a longitudinal cross sectional view of the viscous heater according to the first embodiment of the present invention.
Figure 5:
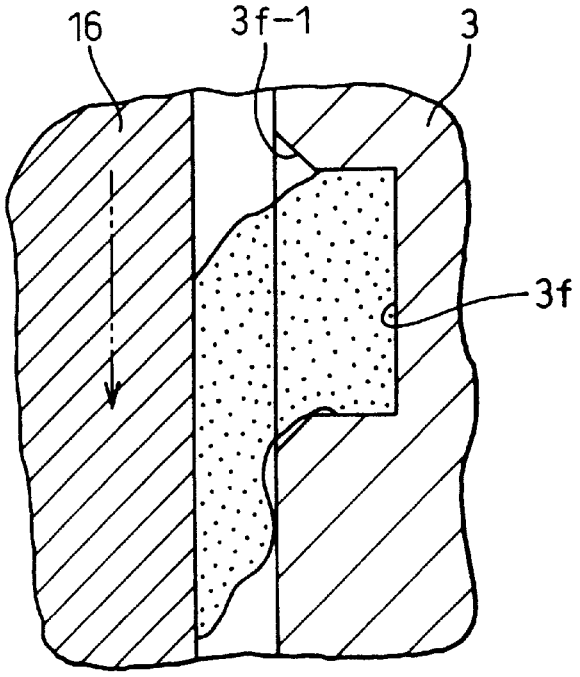
FIG. 5 is an enlarged cross sectional view of a feed groove.

As shown in FIG. 1, the rear plate 3 is, at a location below the central part of the rear plate 3, formed with a feed hole 3*e* as a part of a feed passageway, which has a flow area larger than that of the recovery hole 3*c* and which extends, also, axially therethrough. The rear plate 3 is, has also shown in FIGS. 2 and 5, a feed groove 3*f* as the remaining part of the feed passageway, which is opened to the heat generating chamber 10 and which has an inner end, which is in communication with the feed hole 3*e*. As shown in FIG. 2, the feed groove 3*f* is inclined in the forward direction of the rotating movement of the rotor 16 as shown by the arrow f. Furthermore, the feed groove 3*f* has an edge portion 3*f*-1, which is beveled.

In FIG. 1, silicone oil as a viscous fluid, which can change between the liquid and gaseous states in accordance with the temperature, is stored in the storage chamber SR and the heat generating chamber 10. In the heat generating chamber 10, the silicone oil is located in the gap (heat generating gap) between the inner surface of the heat generating chamber 10 and the outer surface of the rotor 16. Furthermore, according to the present invention, it is possible that the storage chamber 10 can store an amount of the silicone oil which exceeds the volume of the heat generating gap. As a result, a strict administration of the amount of the silicone oil becomes unnecessary.

In a well known manner, the drive shaft 15 is, at its end projected outwardly from the boss portion 1*c* of the front housing 1, connected to a pulley or a clutch (not shown), which is in kinematic connection with a crankshaft (not shown) of an internal combustion engine by means of a belt (not shown). As a result, a rotating movement of the engine crankshaft is transmitted to the drive shaft 15.

Now, operation of the viscous heater according to the present invention as incorporated into a heating apparatus in a vehicle will be explained. Prior to the start of the rotating movement of the drive shaft 15 by means of the internal combustion engine, movement of the viscous fluid under a gaseous state between the heat generating chamber 10 and the storage chamber SR occurs by way of the gas feed groove 3*a* and the gas feed hole 3*b*. Furthermore, the silicone oil has, due to its own weight, the same liquid heights in the heat generating chamber 10 and the storage chamber SR. In other words, the amount of the silicone oil contacting the rotor 16, which is to be subjected to shearing by the rotor when the latter is subjected to the rotating movement, is small. As a result, at the start of the rotating movement of the drive shaft 15, a small amount of torque is sufficient to cause the apparatus to be brought into operation, thereby reducing the generation of shock.

The rotating movement applied to the drive shaft 15 causes the rotor 16 to be rotated about its axis O (FIG. 2) in the heat generating chamber 10, which causes the silicone oil to be subjected to shearing at the gap between the inner surface of the heat generating chamber 10 and the outer surface of the rotor 16. The heat generated by the shearing of the silicone oil is subjected to heat exchange with the recirculating water in the front and rear water jackets FW and RW, thereby heating the water, which is supplied to a heating system for the vehicle.

In the operation of the viscous heater according to present invention, the silicone oil in the heat generating chamber 10 is subjected to shearing, while a gas is included in the silicone oil as bubbles. A quick and smooth movement of these bubbles into the storage chamber SR is obtained due to the fact that the gas groove 3*a* and the gas hole 3*b* connect the upper part of the heat generating chamber 10 and the upper part of the storage chamber SR with each other and that the recovery hole 3*c* is, at its end adjacent the recovery chamber SR, opened to the latter at a location above the level of the silicone oil stored in the storage chamber SR.

Furthermore, the storage chamber SR is in communication with the heat generating chamber 10 at its central area, while, in the storage chamber SR, the silicone oil is, under the effect of its own weight, located at the bottom of the chamber SR. Thus, a Weissenberg effect as effectively generated by the particular shape of the rotor 16 cooperates with the movement of the gas, so that the silicone oil from the heat generating chamber SR is recovered in the storage chamber SR via the recovery hole 3*c*. Simultaneously, due to the surface tension of the silicone oil, the rotor 16 rotating in the heat generating chamber 10 causes the silicone oil in the storage chamber SR to be sucked into the chamber 10 via the feed groove 3*f* and the feed hole 3*e*. In this case, movement of the silicone oil held between the front inner surface of the heat generating chamber 10 and the front outer surface of the rotor 16 easily occurs by way of the connection hole 16*a*.

Furthermore, according to the present invention, the feed hole 3*e* has an effective flow area larger than that of the recovery hole 3*c*, so that the amount of the oil fed to the heat generating chamber 10 is larger than the amount of the oil recovered to the storage chamber SR. In this case, the silicone oil stored at the storage chamber SR is quickly and smoothly fed to the peripheral area of the heat generating chamber 10 via the feed groove 3*f*. Furthermore, the silicone oil fed to the peripheral area of the heat generating chamber 10 is quickly fed to the central area of the heat generating chamber 10 under the Weissenberg effect.

In this way, a heat generated at the gap between the inner surface of the heat generating chamber 10 and the outer surface of the rotor 16 is quickly increased. Furthermore, during the rotating movement of the drive shaft 15, replacement of the silicone oil always occurs between the heat generating chamber 10 and the storage chamber SR, resulting in a generation of a sufficient amount of a heat, while keeping a desired shaft seal operation.

Furthermore, according to the present invention, an amount of the silicone oil larger than the volume of the heat generating gap is held in the storage chamber SR, so that a concentration of a shearing to a particular part of the silicone oil is prevented, thereby delaying degradation of the silicone oil.

In the viscous heater according to the present invention, the heat generating chamber 10 as well as the storage chamber SR are under a closed condition. Thus, the silicone oil in the heat generating chamber 10 and the storage chamber SR are prevented from being contacted with the newly introduced air, which prevents moisture from being absorbed. Thus, degradation of the silicone oil is less likely.

When the rotating movement of the drive shaft 15 is stopped, the movement of the gas and the weight of the silicone oil cause the level of the silicone oil to be equalized between the heat generating chamber and the storage chamber.

Figure 6:
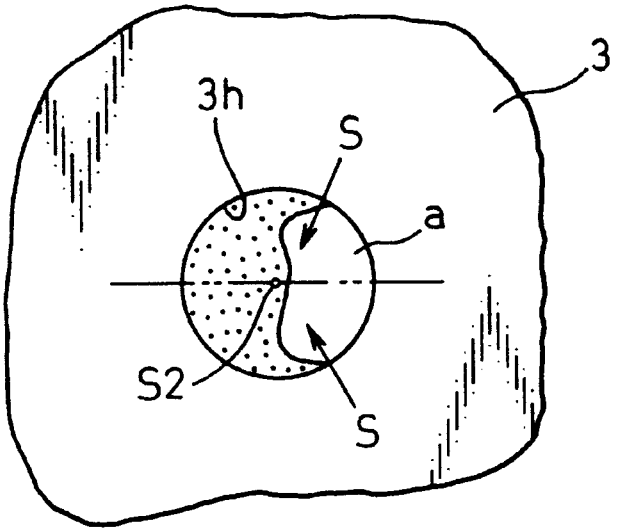
FIG. 6 is similar to FIG. 3, but illustrates a less effective shape of the first recovery hole included in the scope of the present invention.
Figure 7:
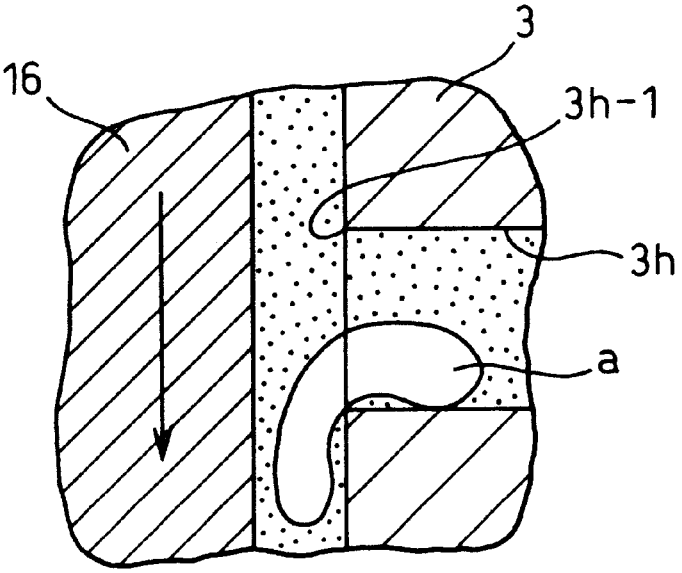
FIG. 7 is a cross sectional view of the first recovery hole in FIG. 6.
Figure 8:
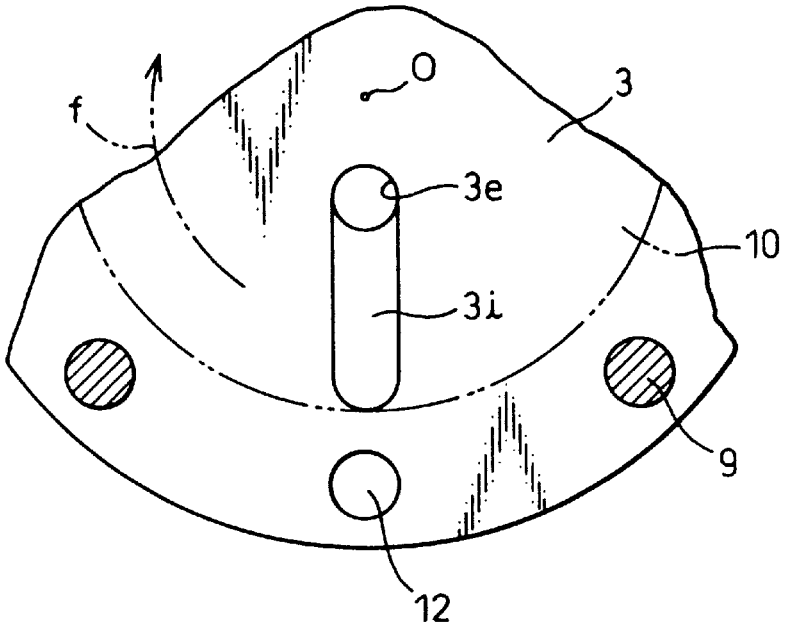
FIG. 8 is a partial front elevational view of a feed groove of a less effective shape also included in the scope of the present invention.

Now, an advantage of the construction of the first embodiment will be explained in comparison with the lesser modification as shown in FIGS. 6 to 8. Namely, in the modification, the rear plate 3 is formed with a recovery hole 3*h* axially therethrough shown in FIGS. 6 and 7. However, unlike to the first embodiment in FIGS. 3 and 4, the recovery hole 3*h* is, at the end opened to the heat generating chamber 10, formed with a circular edge 3*h*-1 unlike the edge which is constructed by the arc shaped portion 3*c*-1 and the straight portion 3*c*-2 in the first embodiment in FIG. 3. Furthermore, in the structure in FIGS. 6 and 7, the edge 3*h*-1 is sharp. In other words, the edge 3*h*-1 is not beveled as is the case in the first embodiment (see the beveled edge 3*c*-1 in FIG. 4). Furthermore, as shown in FIG. 8, the feed groove 3*i* on the rear plate 3 extends radially outwardly without being inclined in the direction of the rotating movement as shown by an arrow f unlike the feed groove 3*f* in the first embodiment in FIG. 2. Furthermore, the feed groove 3*i* has a sharp edge unlike the beveled edge 3*f*-1 in the first embodiment in FIG. 2.

According to the test conducted on the modification shown in FIGS. 6 to 8, a smooth and quick movement of bubbles a included in the silicone oil in the heat generating chamber 10 to the storing chamber SR was not obtained. The reason for the less smooth and quick movement of the bubbles is considered to be as follows. First, as shown in FIGS. 6 and 7, the transverse cross sectional shape of the recovery hole 3*h* is a general circular shape. As a result, the bubbles a are subjected to a relatively large contraction force p from a front edge of the recovery hole 3*h* in a direction of the rotating movement of the rotor 16. This contraction force s is shown as a vector notation in the drawing. Second, the recovery hole 3*h* is opened to the heat generating chamber 10 substantially at a right angle, which makes it difficult for the bubbles a to easily move into the recovery hole 3*h*. See FIG. 7 in comparison with FIG. 4.

Furthermore, in the viscous heater of the modification in FIGS. 6 to 8, a smooth feed of the recovered silicone oil in the storage chamber SR to an outer peripheral area of the heat generating chamber was difficult. The reason for less smooth feed of the recovered silicone oil is considered as follows. First, in the embodiment in FIGS. 6 to 8, the feed groove 3*i* extends outwardly of the rotor 16 without being inclined. As a result, the rotating movement of the rotor 16 causes the silicone oil in the feed passageway 3*i* to be urged to an inner side wall of the feed groove 3*i*, which makes it difficult for the silicone oil to be smoothly moved radially outwardly in the rotor 16. Second, the feed groove 3*i* is opened substantially at a right angle to the heat generating chamber 10, which makes it difficult to move the silicone oil smoothly to the heat generating chamber.

Contrary to this, in the viscous heater in the embodiment in FIGS. 2 to 4, the recovery hole 3*c* is in such a shape that a generation of a large contraction force s in the bubbles a in the recovery hole 3*c* is prevented. Furthermore, the provision of the beveling 3*c*-1 at the edge of the recovery hole 3*c* allows the bubbles a to be smoothly and quickly moved to the recovery chamber SR. See FIG. 4 in comparison with FIG. 7.

Furthermore, in the viscous heater of the embodiment in FIG. 1, the feed groove 3*f* is inclined in the forward direction of the rotating movement of the rotor 16 while the groove 3*f* extends radially outwardly, and the feed groove 3*f* is formed with a beveled outer edge 3*f*. Thus, quick feeding of the silicone oil from the storage chamber SR to the peripheral portion of the heat generating chamber was obtained.

In short, the preferred embodiment in FIGS. 1 to 5 can obtain a quick increase in the heat generating amount at the gap between the inner surface of the heat generating chamber and the outer surface of the rotor 16 after the viscous heater is brought into operation in comparison with the modification in FIGS. 6 to 8.

Second Embodiment

Figure 9:
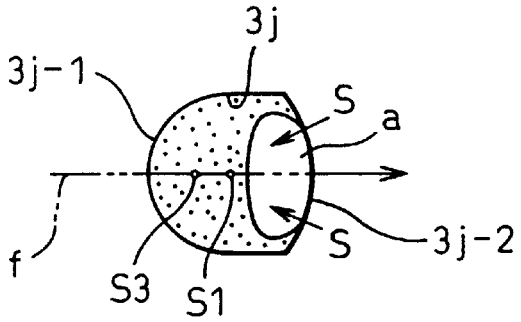
FIG. 9 is similar to FIG. 6 but illustrates another example of the shape of the end of the recovery hole at the end to the heat generating chamber.

In place of the recovery hole 3*c* in the rear plate 3 shown in FIG. 3 in the first embodiment, the preferred modification in FIG. 9 employs a recovery hole 3*j* formed in the rear plate. In this embodiment, the recovery hole 3*j* is, at an axial end adjacent the heat generating chamber, formed with an edge formed by a rear portion 3*j*-1 and the front portion 3*j*-2 in a direction of the rotating movement of the rotor as shown by an arrow f. Similar to the first embodiment in FIG. 3, the rear edge 3*j*-1 is formed as an arc shape centered at the point S1. However, unlike the straight front edge 3*c*-2 in the first embodiment in FIG. 3, the front edge 3*j*-2 in the embodiment in FIG. 9 is formed as an arc shape centered at a center point S3, which is located rearward from the center point S1 of the rear edge portion 3*j*-1 in the direction of the rotating movement of the rotor as shown by the arrow f.

In the embodiment in FIG. 9, the recovery hole 3*j* is a shape by which a bubble is prevented from being subjected to a large compression force, thereby obtaining a similar advantage to that in the first embodiment.

Third Embodiment

Figure 10:
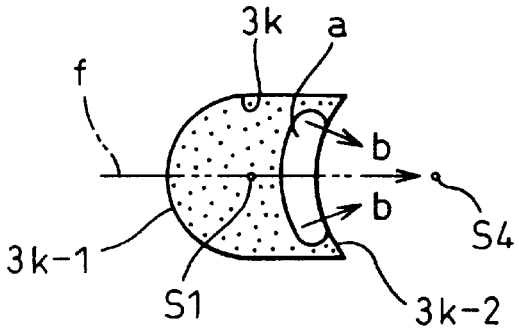
FIG. 10 is similar to FIG. 9 but illustrates another embodiment.

In the third embodiment in FIG. 10, the recovery hole 3*k* has, at an axial end opened to the heat generating chamber, an edge which is constructed by a rear arc shaped portion 3*k*-1 and a front arc shaped portion 3*k*-2 in the direction of the rotating movement of the rotor as shown by a dotted arrow f. In this embodiment, the rear edge portion 3*k*-1 is also centered at the point S1. However, the front edge portion 3k-2 is centered at a point S4 which is located forward from the hole 3k in the rotating direction f. In other words, the edge portion 3k-2 is rearwardly projected.

In the operation of the third embodiment, the recovery hole 3k is a shape by which a bubble a is subjected to an expansion force b, thereby generating the similar advantage to that in the first embodiment.

Fourth Embodiment

Figure 11:
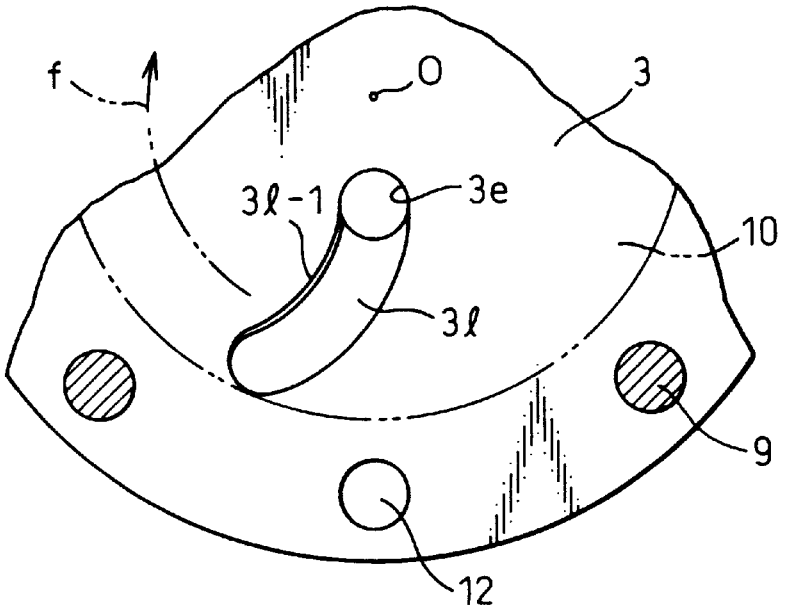
FIG. 11 is similar to FIG. 8 but illustrates another embodiment of the present invention.

FIG. 11 shows a fourth embodiment, which is directed to a modification of a feed groove 3l in the rear plate 3. Namely, as similar to the first embodiment in FIG. 2, the groove 3l is inclined forwardly in the direction of the rotating movement of the rotor 10 as shown by an arrow f. However, unlike to the embodiment in FIG. 2, the beveling of the groove 3l is done only at the front edge portion 3l-1 in the direction of the rotating movement f as shown in FIG. 11. In other words, an acute edge remains at a rear portion in the direction of the rotating movement as shown by the arrow f.

In the operation of this embodiment, the beveled front edge portion 3l-1 allows the silicone oil to be easily moved toward the peripheral portion of the rotor 16 during the rotating movement of the rotor 16. Thus, a similar advantage to that of the first embodiment is obtained.

Fifth Embodiment

Figure 12:
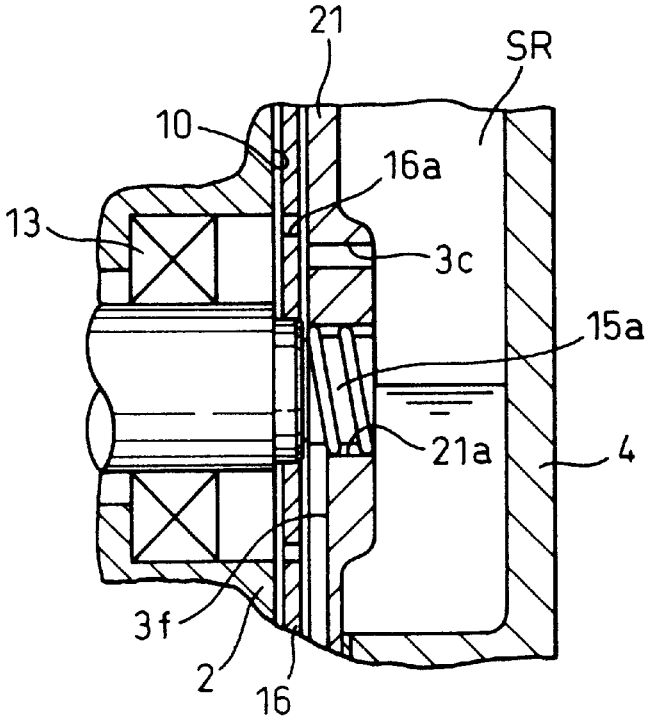
FIG. 12 illustrates a further another embodiment of the present invention directed to a provision of a feed pump.

The embodiment shown in FIG. 12 is directed to a modified shape of a rear plate 21. Namely, in this embodiment, the rear plate 21 is formed with a feed opening 21a, while the drive shaft 15 has an axially elongated end 15a located in the feed opening 21a. A screw groove is formed on the end 15a of the drive shaft, so that a screw type pump is constructed which functions to positively feed the viscous fluid in the storage chamber SR into the heat generating chamber 10. The remaining structure is the same as that in the first embodiment.

In the operation of the embodiment in FIG. 12, the rotating movement of the drive shaft 15 causes the screw groove on the end 15a to suck the viscous fluid in the storage chamber SR and feed it to the heat generating chamber 10. As a result, an increased amount of the viscous fluid is obtained at the gap between the inner surface of the heat generating chamber and the outer surface of the rotor 16, thereby increasing a heat generated at the gap.

In place of the screw type pump in the embodiment in FIG. 12, a different type of pump such as a gear pump, trochoid pump, and a centrifugal pump can be employed. In the case where the pump is on an axis different from the axis of the shaft 15, a separate drive source can be provided for generating a rotating movement applied to the pump.

We claim:

1. A viscous heater comprising:

a housing;

a heat generating chamber in the housing;

a heat emission chamber in the housing, the heat emission chamber being located adjacent to the heat generating chamber and being for receiving a liquid to be recirculated;

a drive shaft which is rotatably connected to the housing, and;

a rotor which is located in the heat generating chamber and is rotated by said drive shaft;

the rotor and the heat generating chamber having opposed surfaces between which a gap is created;

a viscous fluid located at within the gap generates heat due to the shearing of the viscous fluid in the gap during the rotating movement of the rotor; and the heat generating chamber being outwardly sealed, while said housing has a storage chamber which is also outwardly sealed and is in communication with the heat generating chamber via a recovery passageway as well as a feed passageway in said housing, the storage chamber being capable of storing a volume of the viscous fluid which exceeds the volume of said gap.

2. A viscous heater according to claim 1, wherein said recovery passageway is in communication with the heat generating chamber at its central part and the recovery passageway and the feed passageway are always under a opened condition during the operation of the drive shaft.

3. A viscous heater according to claim 1, wherein said recovery passageway is, at its open end to the storage chamber, located at a position above the level of the liquid state viscous fluid in the storage chamber and said feed passageway is, at its open end to the storage chamber, located at a position below the level of the liquid state viscous fluid in the storage chamber.

4. A viscous heater according to claim 1, wherein said feed passageway has an effective flow area which is larger than that of the recovery passageway.

5. A viscous heater according to claim 1, further comprising a feeding means arranged in the feed passageway for positive feeding of the viscous fluid in the storage chamber into the heat generating chamber during operation.

6. A viscous heater according to claim 5, wherein said feeding means comprise a pump having a shaft which is concentric with respect to the drive shaft and a screw thread on the shaft.

7. A viscous heater according to claim 1, wherein said recovery passageway has an end opened to the heat generating chamber having an edge which has, at least at a forward portion in the direction of the rotating movement of the rotor, a formation which caused the gas to be sucked from the heat generating chamber to the storage chamber under the effect of the rotating movement of the rotor.

8. A viscous heater according to claim 7, wherein said formation is a bevel.

9. A viscous heater according to claim 1, wherein said recovery passageway has an end opened to the heat generating chamber having an edge which has a front portion of an arc or straight shape in the direction of the rotating movement of the rotor, having a curvature, which is larger than that of a rear portion of the edge.

10. A viscous heater according to claim 1, wherein said feed passageway extends toward a peripheral portion of the rotor.

11. A viscous heater according to claim 10, wherein the arrangement of said feed passageway is such that the viscous fluid is fed into the heat generating chamber from the storage chamber due to the rotating movement of the rotor.

12. A viscous heater according to claim 11, wherein said feed passageway has a groove on the housing and extending radially, which groove is inclined forwardly in the direction of the rotating movement of the rotor.

13. A viscous heater according to claim 11, wherein said feed passageway has a groove on the housing and extending radially, which groove is curved forwardly in the direction of the rotating movement of the rotor.

14. A viscous heater according to claim 12, wherein said groove has an edge which is, at least at the forward portion in the direction of the rotating movement of the rotor, beveled.

15. A viscous heater according to claim 1, wherein said housing is further formed with a gas passageway which connects the heat generating chamber and the storage chamber with each other.

16. A viscous heater according to claim 15, wherein said gas passageway connects the upper part of the heat generating chamber and the upper part of the storage chamber with each other.

17. A viscous heater according to claim 1, wherein said rotor is formed as a flat disk shape.

18. A viscous heater according to claim 1, wherein said rotor has, at its central part, at least one hole extending axially therethrough.

* * * * *

UNITED STATES PATENT AND TRADEMARK OFFICE

CERTIFICATE OF CORRECTION

PATENT NO. : 5,911,361

DATED : June 15, 1999

INVENTOR(S) : Shigeru Suzuki et al. .

It is certified that error appears in the above-identified patent and that said Letters Patent is hereby corrected as shown below:

Column 1, line 25, change "with-each" to --each--;

Column 2, line 9, delete "is";

Column 2, line 65, change "a-moisture" to --moisture--;

Column 3, line 39, delete "an";

Column 3, line 41, after "able" insert -- to be brought into operation, thereby reducing the generation of shock--;

Column 4, line 55, after "viscous" delete a comma ",", same line, after "heater" insert a comma --,--;

Column 6, line 19, delete "another";

UNITED STATES PATENT AND TRADEMARK OFFICE

CERTIFICATE OF CORRECTION

PATENT NO. : 5,911,361

DATED : June 15, 1999

INVENTOR(S) : Shigeru Suzuki et al.

It is certified that error appears in the above-identified patent and that said Letters Patent is hereby corrected as shown below:

Column 6, line 41, change " is faced with " to --faces--;

Column 7, line 44, delete "is,", same line after "has" insert a comma --,--;

Column 9, line 5,line 11,(3rd occurrence)line 15, line 16, 1st and 2nd occurrence delete "a".

Column 9, line 36, delete "to";

Column 11, line 15, delete "to".

Signed and Sealed this

Twenty-fifth Day of April, 2000

*Attest:*

*Attesting Officer*

Q. TODD DICKINSON

*Director of Patents and Trademarks*